United States Patent [19]

Patterson

[11] 4,127,357

[45] Nov. 28, 1978

[54] VARIABLE SHROUD FOR A TURBOMACHINE

[75] Inventor: William R. Patterson, Cincinnati, Ohio

[73] Assignee: General Electric Company, Cincinnati, Ohio

[21] Appl. No.: 809,582

[22] Filed: Jun. 24, 1977

[51] Int. Cl.[2] ..... F01D 11/08

[52] U.S. Cl. ..... 415/116; 415/138; 415/170 R; 415/177

[58] Field of Search ..... 415/171, 174, 12, 134, 415/136, 110, 113, 128, 138, 170 R, 177, 178, 180, 116; 60/39.32, 39.66

[56] References Cited

U.S. PATENT DOCUMENTS

| | | | |
|---|---|---|---|
| 2,962,256 | 11/1960 | Bishop | 415/136 |
| 2,994,472 | 8/1961 | Botje | 415/113 UX |
| 3,146,992 | 9/1964 | Farrell | 415/12 |
| 3,227,418 | 7/1966 | West | 415/174 X |
| 3,966,354 | 6/1976 | Patterson | 415/116 |

*Primary Examiner*—Carlton R. Croyle
*Assistant Examiner*—Donald S. Holland
*Attorney, Agent, or Firm*—Dana F. Bigelow; Derek P. Lawrence

[57] ABSTRACT

A turbine shroud segment is supported by a pair of eccentric shafts which are rotated in response to the engine operating temperatures to selectively vary the radial position of the shroud segment so as to minimize the radial clearance between the shroud segment and the rotatable blades circumscribed therein during variable operating conditions. The bimetal actuator moves in response to changes in the temperature of the cooling air to rotate a ring gear which in turn rotates the eccentric shafts to modulate the radial position of the shroud segment. By proper selection of component design specification and operating parameters, the radial clearance can be minimized during steady-state operating conditions without attendant rubbing during transient operating conditions.

15 Claims, 3 Drawing Figures

VARIABLE SHROUD FOR A TURBOMACHINE

The invention herein described was made in the course of or under a contract, or subcontract thereunder, with the U.S. Department of the Air Force.

BACKGROUND OF THE INVENTION

This invention relates generally to gas turbine engines and, more particularly, to a method and apparatus for minimizing the radial clearance between the rotor and shroud by automatically, and selectively, varying the position of the shroud in response to certain predetermined engine operating conditions.

As turbine engines continue to become more reliable and efficient by changes in methods, designs and materials, losses which occur from excessive clearances between relatively rotating parts become more important in the many design considerations. In many turbine engine applications, there is a requirement to operate at variable steady-state speeds and to transit between those speeds as desired in the regular course of operation. For example, in a jet engine of the type used to power aircraft, it is necessary that the operator be able to transit to a desired speed whenever he chooses. The resulting temperature and rotor speed changes bring about attendant relative growth between the rotor and the surrounding shroud and, in order to maintain the desired efficiency, this relative growth must be accommodated for. The primary concern is to maintain a minimum clearance between the stator and rotor while preventing any frictional interference therebetween which would cause rubbing and resultant increase in radial clearance during subsequent operation. When considering the transient operating requirements as mentioned hereinabove, the relative mechanical and thermal growth patterns of the rotor and shroud present a very difficult problem.

Various schemes have been devised to variably position the stationary shroud in response to engine operating parameters in order to reduce rotor/shroud clearance. One such apparatus which is shown and claimed in U.S. Pat. No. 3,966,354, issued on June 29, 1976 and assigned to the assignee of the present invention, regulates the amount of cooling air which flows over the turbine shroud support in response to the temperature of that cooling air. Other schemes for performing similar functions are shown in U.S. patent application Ser. No. 710,872, filed on Aug. 2, 1976 and assigned to the assignee of the present invention.

It is therefore an object of the present invention to provide an efficient turbine engine which is capable of transiting between various speeds while maintaining a minimum clearance between its rotor and shroud.

Another object of the present invention is the provision in a turbine engine for the selective modulation of the shroud position so as to minimize the clearance between the shroud of the rotor during operation under variable conditions.

Yet another object of the present invention is to selectively modulate the position of a rotor shroud in response to variable steady-state and transient operating conditions.

Still another object of the present invention is to automatically provide positive and variable positioning of a shroud with respect to a circumscribed rotor in order to maintain a minimum clearance therebetween during variable operating conditions.

These objects and other features and advantages become more readily apparent upon reference to the following description when taken in conjunction with the appended drawings.

SUMMARY OF THE INVENTION

Briefly, in accordance with one aspect of the invention, each turbine shroud segment of the gas turbine engine is supported by a pair of circumferentially spaced eccentric shafts which are rotated in response to variable engine operating parameters in order to automatically vary the radial position of the shroud and to thereby minimize the clearance between the shroud and the circumscribed rotor. The eccentric portions of the shaft frictionally engage radially outward extending brackets from the shroud segments so as to translate the rotary motion of the shaft into a substantially linear radial direction.

By another aspect of the invention, rotary motion is transmitted to the shaft by way of gears attached thereto which gears are rotated by a single ring gear which in turn is rotated in response to the engine parameter changes.

By yet another aspect of the invention, the ring gear is made to move in a circumferential direction by means of an actuator whose length is dependent upon the cooling air to which it is exposed, the temperature of the cooling air being proportional to the speed of the engine. The thermal actuator is preferably a partial ring of higher or lower thermal expansion material than the shroud support element to which its one end is connected. The other end is, of course, attached to the ring gear to rotate it with thermal growth.

By proper selection of the eccentricity of the shaft and the length of the actuator, various combinations of motion response to temperature can be obtained. In addition, by proper adjustment of the mass of the outer shroud and support location of the thermal actuator, various combinations of transient response can be obtained. With the proper combinations, it is possible to modulate the position of the shroud so as to minimize the rotor/shroud clearance during transient and steady-state conditions of operation.

In the drawings as hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
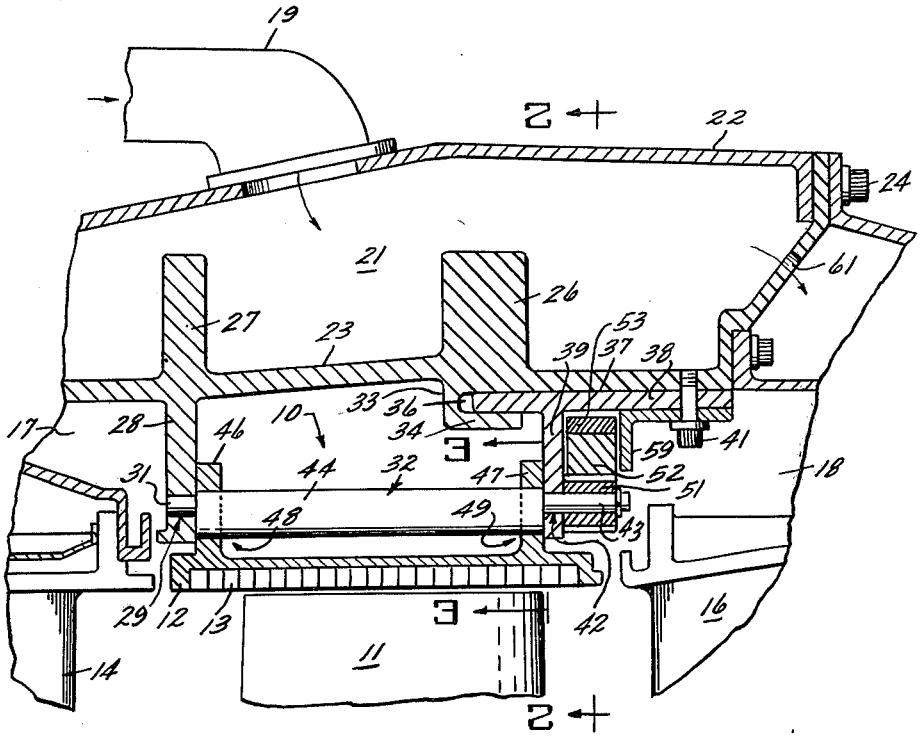
FIG. 1 is a partial section view of the turbine/shroud portion of a jet engine having the inventive apparatus embodied therein.

Referring now to FIG. 1, the invention is shown generally at 10 as being applicable to a gas turbine engine which includes a row of circumferentially spaced turbine blades 11 which are circumscribed by a plurality of circumferentially spaced and overlapping shroud segments 12. The shroud segments 12 have disposed in their inner periphery an abradable material 13 such as honeycomb or the like to facilitate occasional interference and resultant rubbing by the blades 11 under certain operating conditions. As in conventional operation of a single-stage high pressure turbine, the hot exhaust gases from the combustor (not shown) pass through the row of the high pressure nozzles 14, through the row of turbine blades 11 to impart rotary motion thereto, and downstream to the row of low pressure nozzles 16. Cooling air is provided to the high pressure nozzles 14 and the low pressure nozzles 16 by way of the cooling air plenums 17 and 18, respectively, in a manner well known in the art.

Cooling air to the system is obtained in such a manner as by bleeding air from the compressor and introducing it by way of a plurality of bleed off conduits 19 which discharge cooling air into a plenum 21 partially defined on the outer side by a manifold 22. Further defining the plenum 21, on the inner side thereof, is a shroud support ring 23 attached to the downstream end of the manifold 22 by a plurality of bolts 24. Extending radially outward from the shroud support 23 is a pair of flanges 26 and 27 which tend to increase the mass of the shroud support 23 and therefore the thermal inertia thereof. It will be recognized that the size of these flanges and the number thereof can be varied to accommodate any desired thermal response of the shroud support. Extending inwardly from the main body of the shroud support 23 is a forward flange 28 having a plurality of circumferentially spaced holes 29 formed therein for rotatably receiving a cylindrical portion 31 of a support shaft 32.

Downstream from the forward flange 28, proximate the flange 26, is a rear L-shaped flange 33 whose axial leg 34 partially defines a circumferential slot 36. A hanger ring 37, which is T-shaped in cross section with an axial portion 38 and radial portion 39, is rigidly mounted to the shroud support 23 by insertion of one end of the axial portion 38 in the slot 36 and by attachment of the other end thereof to the shroud support 23 by a plurality of circumferentially spaced bolts 41.

Formed in the radial portion 39 of the T-shaped hanger brackets 37 is a plurality of circumferentially spaced holes 42 for receiving a downstream cylindrical portion 43 of the support shaft 32. Disposed between the cylindrical portions 31 and 43, and comprising the remaining portion of the support shaft 32 is an elongate cylindrical cam portion 44 whose axis is offset from that of the cylindrical portions as can be seen in FIG. 3.

The plurality of shroud segments 12 are each attached to and supported by a pair of support shafts 32 at the cam portion 44 thereof. At each circumferential end of each of the shroud segments 12, are a pair of axially spaced flanges 46 and 47 having circular holes 48 and 49, respectively, formed therein for receiving the cam portion 44 of the support shaft 32.

Figure 3:
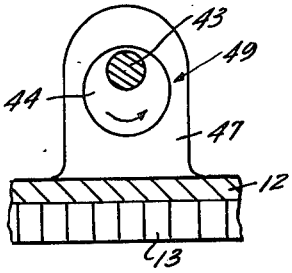
FIG. 3 is a sectional view thereof as seen along line 3—3 of FIG. 1.

Referring to FIG. 3, the eccentric support shaft operates to radially position the shroud segment 12 as follows. As the support shaft 32 is rotated on the axis of the cylindrical portion 43 from the position shown, the cam portion 44 follows an eccentric pattern to move the shroud segment both circumferentially and radially outward. Continued rotation then moves the shroud segment circumferentially in the other direction and radially inward. By proper selective placement of the cam portion in its rotational angle, one can obtain the desired radial movement of the shroud in order to maintain the proper clearance. Since all of the segments are moved in unison, a circumferential movement will only tend to cause the segments to rotate in unison and will therefore not disrupt their sealing relationship.

Figure 2:
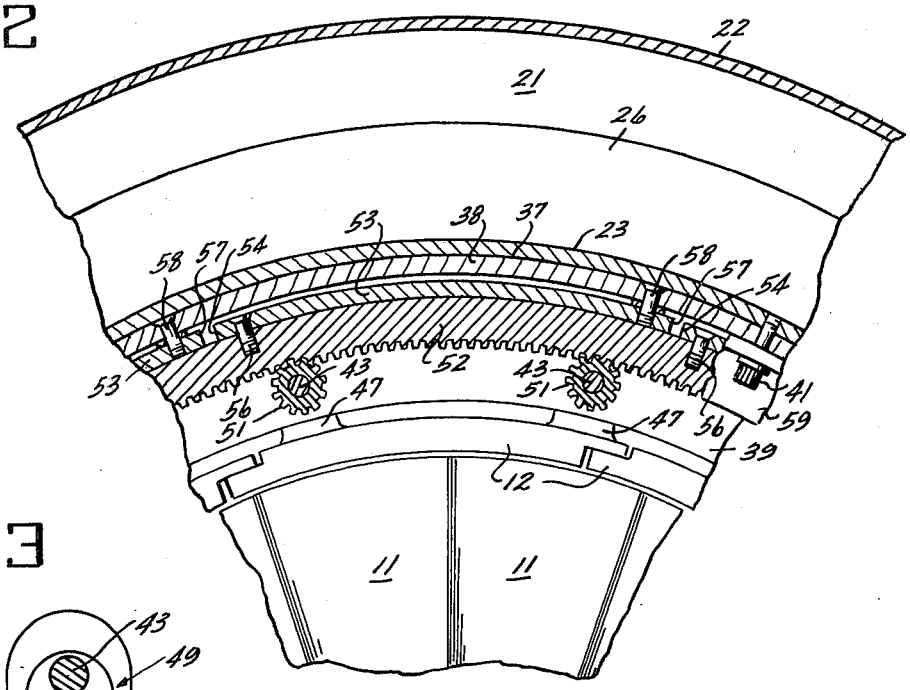
FIG. 2 is a sectional view thereof as seen along lines 2—2 of FIG. 1.

In order to rotate the support shafts 32, torque is applied to the downstream cylindrical portion 43 by a gear 51 which is rigidly attached to it by way of a forced fit or the like. Each shroud segment 12 then has a pair of circumferentially spaced flanges 47 with associated support shafts 32 and gears 51. Rotation of the gears 51 in unison is accomplished by a single ring gear 52 which operably engages the gears 51 at its inner periphery. Rotation of the ring gear 52 is accomplished by an arcuate actuator ring 53 which is closely disposed on the outer periphery of the ring gear and which has its one end 54 rigidly attached to the ring gear 52 by a bolt 56 and has its other end 57 rigidly attached to the axial portion of the T-shaped hanger bracket 37 by a bolt 58. Although the preferred embodiment as shown in FIG. 2 has an actuator ring 53 for each shroud segment 12, it will be recognized that a smaller number of actuators may be incorporated while still transmitting enough torque to the ring gear 52 for rotation thereof. In order to positively retain the ring gear and actuator ring combination in an axial position, an L-shaped retainer ring 59 is held in close axial relationship therewith with a plurality of bolts 41.

It should be noted that the actuator ring 53 acts to rotate the ring gear 52 in response to the thermal environment to which it is exposed. Accordingly, it is necessary that the coefficient of thermal expansion of the actuator ring be different than that of the shroud support 23 since it is this shroud support or an extension thereof, the T-shaped hanger bracket 37, to which the actuator is attached at its base or fixed end 57. The other end 54 of the actuator ring is of course free to grow relative to the shroud support 23 in response to temperature changes to thereby rotate the ring gear 52.

In operation, the cooling air, which is bled off from the compressor so that its temperature is dependent on the speed of the engine, is introduced by the conduit 19 into the plenum 21 where it directly contacts the shroud support 23 to change the temperature and therefore the size thereof. A portion of the air is directed through the holes 61 for the cooling of the low pressure nozzles 16. Since the shroud support 23, the T-shaped hanger bracket 37 and the actuator ring 53 are all so closely associated, they are at substantially the same temperature. Further, since the coefficient of thermal expansion is different for the shroud support 23 and the actuator ring 53, the actuator ring 53 will grow or shrink with respect to the shroud support 23 as the temperatures thereof are changed. This relative thermal growth or shrinkage will, in turn, rotate the ring gear 52 and the gears 51 to cause a radial movement of the shroud segment 12 in a pattern which facilitates the maintenance of close shroud/rotor clearance for all steady-state and transient conditions of engine operation. By a proper selection of the eccentricity of the support shaft 32 and the length of the individual actuators 53, the various combinations of motion response to temperature can be obtained. In addition, by proper adjustment of the mass of the shroud support 23 and that of the thermal actuator 53, various combinations of transient response can be obtained. By so selecting the design specification to match the performance requirements, the clearance can be minimized for all phases of operation.

Although the preferred embodiment has been described hereinabove with certain design structural characteristics, it will be understood that various other designs and configurations can be employed to achieve the objects of the present invention as contemplated. For example, the support shaft cam portion 44 has been described as being a cylindrical portion offset from another cylidrical portion, but the shape of the cam portion may be varied to accommodate the desired movement response of the shroud segments. Further, the rotation of the support shaft 32 may be accomplished by means other than with an annular ring gear 52 and a plurality of arcuate actuator rings 53. For example, a thermostatically operated mechanism such as a motor or the like could be used to rotate the individual support shafts 32.

Having thus described the invention, what is considered novel and desired to be secured by Letters Patent of the United States is:

1. An improved shroud support for a turbomachine of the type having a rotor disposed in close radial relationship with a plurality of circumscribing shroud segments which are positioned by an outer shroud support structure wherein the improvement comprises:

(a) a shaft movably interconnecting the shroud segments and support structure, said shaft being rotatable within the support structure on an axis parallel with the axis of the rotor and having an eccentric surface which frictionally engages and supports a shroud segment; and (b) means to rotate said shaft in response to predetermined turbomachine operating parameters to selectively modulate the radial position of the shroud segment.

2. An improved shroud support as set forth in claim 1 wherein said rotating means comprises a bimetal mechanism exposable to a fluid used for cooling the support structure.

3. An improved shroud support as set forth in claim 1 wherein the shroud segment is supported in at least two places by brackets extending radially outward therefrom.

4. An improved shroud support as set forth in claim 3 wherein each bracket has a shaft frictionally engaging and supporting it.

5. An improved shroud support as set forth in claim 1 wherein said rotating means includes a gear formed on one end of said shaft and engaging a ring gear which rotates in response to changes in the predetermined turbomachine operating parameters.

6. An improved shroud support as set forth in claim 5 wherein said ring gear is connected to and rotated by an actuator ring whose length is variable in response to the temperature of a cooling fluid to which it is exposed.

7. An improved shroud support mechanism of a turbomachine for adjustably locating a circumferential shroud segment in close radial relationship with a row of rotatable airfoils wherein the improvement comprises:

(a) a pair of circumferentially spaced brackets attached to and extending radially outward from the shroud segment;

(b) a pair of shafts each rotatably disposed in one of said brackets, said shafts each being rotatable on a supporting axis parallel with the axis of the rotatable airfoils and having an eccentric portion which frictionally engages one of said brackets; and (c) means for rotating said pair of shafts in response to predetermined changes in turbomachine operational parameters to selectively vary the radial location of the shroud segment.

8. An improved shroud support mechanism as set forth in claim 7 wherein said eccentric portion is substantially cylindrical in cross section and is axially offset from said supporting axis.

9. An improved shroud support mechanism as set forth in claim 7 wherein that portion of said bracket which is frictionally engaged by the eccentric portion of the shaft is a circular surface.

10. An improved shroud support mechanism as set forth in claim 7 wherein said rotating means comprises a bimetal mechanism which is responsive to the temperature of a fluid to which the support structure is exposed.

11. An improved shroud support mechanism as set forth in claim 7 wherein said rotating means includes gears formed on the ends of said pairs of shafts and engaging a ring gear which rotates in response to said predetermined changes in turbomachine operating parameters.

12. An improved shroud support mechanism as set forth in claim 11 wherein said ring gear is connected to and rotated by an actuator ring whose length is variable in response to the speed of the turbomachine.

13. A method of minimizing the radial clearance between a turbomachine rotor and a circumscribing shroud of a turbomachine which is operable over variable steady-state and transient operating conditions, comprising the steps of:

(a) suspending a shroud segment on a plurality of eccentric shafts; and (b) rotating said shafts in response to predetermined turbomachine operating parameters to selectively modulate the radial position of the shroud segment to closely coincide with that of the outer periphery of the rotor over a range of said variable operating conditions.

14. A method of reducing clearances as set forth in claim 13 wherein the rotating of said shafts is accomplished by a bimetal mechanism which is exposable to a fluid whose temperature is indicative of turbomachine speed.

15. A method of reducing clearances as set forth in claim 13 wherein the shaft rotating step is accomplished by a pair of gears associated with said shafts and a ring gear which operably engages said gears and rotates in response to changes in the speed of the turbomachine.

* * * * *